US005094213A

United States Patent [19]

Dudek et al.

[11] Patent Number: 5,094,213

[45] Date of Patent: Mar. 10, 1992

[54] METHOD FOR PREDICTING R-STEP AHEAD ENGINE STATE MEASUREMENTS

[75] Inventors: Kenneth P. Dudek, Rochester Hills; Charles H. Folkerts, Troy, both of Mich.

[73] Assignee: General Motors Corporation, Detroit, Mich.

[21] Appl. No.: 732,386

[22] Filed: Jul. 18, 1991

Related U.S. Application Data

[63] Continuation-in-part of Ser. No. 653,922, Feb. 12, 1991, abandoned.

[51] Int. Cl.[5] ..... F02M 51/00

[52] U.S. Cl. ..... 123/478

[58] Field of Search ..... 123/478, 416, 417, 486, 123/438; 364/431.03, 431.07, 565, 431.05

[56] References Cited

U.S. PATENT DOCUMENTS

| | | | |
|---|---|---|---|
| 4,386,520 | 6/1983 | Nagaishi | 73/118 |
| 4,437,340 | 3/1984 | Csere et al. | 73/118 |
| 4,502,325 | 3/1985 | Klomp | 73/118 |
| 4,548,185 | 10/1985 | Posniak | 123/571 |
| 4,599,694 | 7/1986 | Aposchanski et al. | 364/431.05 |
| 4,644,474 | 2/1987 | Aposchanski et al. | 364/431.05 |
| 4,664,090 | 5/1987 | Kabasin | 123/494 |
| 4,761,994 | 8/1988 | Sogawa | 73/118.2 |
| 4,860,222 | 8/1989 | Schmidt et al. | 364/550 |
| 4,893,244 | 1/1990 | Tang et al. | 364/431.03 |
| 4,987,773 | 1/1991 | Stiles et al. | 123/478 |
| 5,035,225 | 7/1991 | Mizukoshi | 123/78 |
| 5,050,559 | 9/1991 | Kurosu et al. | 123/478 |

FOREIGN PATENT DOCUMENTS

| | | | |
|---|---|---|---|
| 3416812 | 8/1983 | Fed. Rep. of Germany | 123/478 |
| 3432757 | 9/1984 | Fed. Rep. of Germany | 123/478 |

OTHER PUBLICATIONS

State Functions and Linear Control Systems, 1967, McGraw Hill, Inc. U.S.A., pp. 287-297 Probability, Random Variables, and Stochastic Processes, 1965, McGraw-Hill, Inc. U.S.A. pp. 423-426 (no months provided).

*Primary Examiner*—Raymond A. Nelli
*Attorney, Agent, or Firm*—Anthony L. Simon

[57] ABSTRACT

An engine—powertrain—controller combination includes a microprocessor control unit which predicts a future value of an engine state and uses that predicted value in engine control functions for improved control of the engine—powertrain in such areas as air-fuel ratio control, control of the engine during engine idle, and engine spark timing control.

38 Claims, 7 Drawing Sheets

METHOD FOR PREDICTING R-STEP AHEAD ENGINE STATE MEASUREMENTS

This application is a continuation-in-part of U.S. patent application Ser. No. 07/653,922, filed Feb. 12, 1991, assigned to the assignee of this invention, and abandoned with the filing of this application.

This invention relates engine—powertrain control based on predicted engine states.

The subject of this application is related to copending patent applications U.S. Ser. No. 07/653,931, entitled "Software Air Meter", and U.S. Ser. No. 07/653,923, entitled "Method for Estimating and Correcting Bias Errors in a Software Air Meter", both filed Feb. 12, 1991, concurrently with the parent to this application and assigned to the assignee of this application. The disclosures of patent applications Ser. Nos. 653,931 and 653,923 are hereby incorporated into this application by reference.

BACKGROUND OF THE INVENTION

The air-fuel ratio in a combustion engine affects both engine emissions and performance. With strict modern emissions standards for automobiles, it is necessary to accurately control the air-fuel ratio of the automobile engine, requiring precise measurement of the mass airflow into the engine.

Currently, engine airflow is either measured with a mass airflow sensor or calculated by the speed-density method. Improvements in both types of systems have lead to improved air-fuel ratio control of engines, enabling vehicle manufacturers to meet existing emissions standards. In general, while mass airflow sensors are more accurate than speed-density systems, they are also more expensive.

In an ideal speed-density system, sensor processing and fuel delivery occur instantaneously to allow precise air-fuel ratio control. In reality, however, it takes a finite amount of time to process sensor measurements to compute proper fueling and a finite amount of time to physically deliver the fuel. The delays in the fuel computation and delivery force the fuel control system to compute the fuel to be delivered in a particular cylinder before the actual delivery of the fuel.

In speed-density systems, airflow estimates are based on measures of manifold absolute pressure. The aforementioned delays force speed-density systems to read manifold absolute pressure prior to the theoretically optimal time, which would be during the intake event for the cylinder to be fueled. A typical value for this delay is two to three engine events. Because of the dynamic characteristics of engines, the manifold absolute pressure, and hence airflow, can change dramatically between the time manifold absolute pressure is read (and the fuel computed) and the intake event for the cylinder being fueled. Therefore, in speed-density systems, the lag between the calculated airflow and the actual airflow is prominent. Speed-density calculations are most accurate during static situations. During dynamic situations, when the mass airflow into the engine is changing, the calculated mass airflow into the engine lags the actual mass airflow. This increases the difficulty of properly controlling the air-fuel ratio during transient conditions.

What is desired is a method of achieving increased accuracy in the determination of proper air-fuel ratio for the vehicle engine in vehicles with or without mass airflow meters to enable vehicle manufacturers to meet increasingly tightening emissions standards.

SUMMARY OF THE PRESENT INVENTION

Increased accuracy in speed-density systems can be achieved by using accurate predictions of manifold absolute pressure for the time air and fuel actually enter the engine cylinder, instead of using a value of manifold absolute pressure measured at a time before the cylinder intake valve(s) open. This invention provides an engine—powertrain—controller combination for predicting vehicle engine states and controlling the vehicle engine—powertrain in response to the engine state predictions. Vehicle engine states as referred to in this specification encompass engine parameters that can be mathematically modeled in relation to other engine variables, examples include manifold absolute pressure (MAP), mass airflow into the engine (MAF), and engine speed (RPM). An example of an engine parameter that is not a state is throttle position, which is strictly a function of accelerator pedal position (for conventional systems). Implementation of this invention enables increased accuracy in calculations of proper fuel distribution so that the proper air-fuel ratio at the time of actual combustion can be achieved. Additionally, predictions of engine states such as manifold absolute pressure may be used to control engine spark timing, engine idle air flow, engine idle speed, engine speed and transmission gear selection for electronically controlled transmissions.

The method of predicting vehicle engine states of this invention is an extension of the technique of prediction and estimation as implemented in state observers. The prediction-estimation technique is a two step process: (1) model-based prediction, and (2) measurement-based correction (estimation). In the prediction step, past and present measures of a set of engine parameters, and previous estimations of the desired parameter are used to determine future predictions of the desired state. The number of engine events in the future for which the prediction is made may vary from system to system (note that in this specification engine event is used as the time variable, e.g., two engine events in the future refers to two time events in the future). In the estimation, or measurement-based correction step, the error in the prediction of the present engine event value of the desired state is used in combination with a set of estimator correction coefficients to determine the estimation of the desired state. The method is iteratively executed by a computer-based controller and may be used several times in the controller to predict more than one engine state (e.g., manifold absolute pressure and engine speed may both be predicted). For each state being predicted, a separate set of model parameters and correction coefficients is used. The prediction results are used to control the engine—powertrain of the vehicle.

The model parameters may be determined through statistical reduction of data taken from a test vehicle. The estimator correction coefficients are preferably determined through statistical optimization.

Use of the present invention to predict manifold pressure at the time air and fuel enter the engine cylinder allows precise air-fuel ratio control.

DETAILED DESCRIPTION OF THE INVENTION

Figure 1:
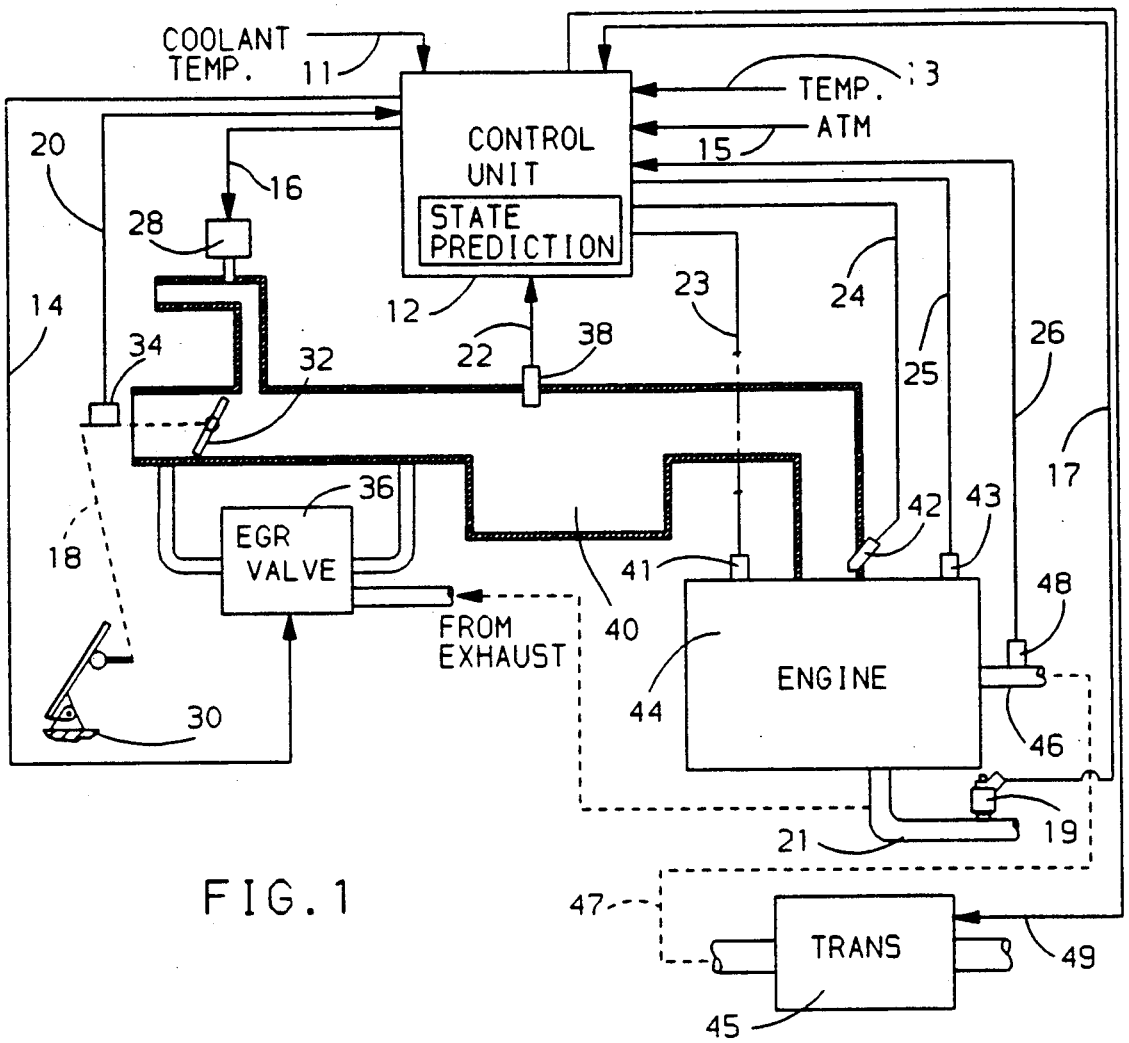
FIG. 1 is a schematic diagram showing an engine—powertrain assembly, sensors, and control unit in which the invention may be implemented.

Referring to FIG. 1 the engine—powertrain assembly shown includes the engine 44, transmission 45, fuel injectors 42, spark plugs 41 and 43, air intake manifold 40, throttle 32, exhaust gas recirculation (EGR) valve 36, idle air control (IAC) valve 28, and exhaust gas manifold 21. The throttle is controlled by accelerator pedal 30 as shown by dotted line 18 and the transmission 45, IAC valve 28, EGR valve 36, spark plugs 41 and 43, and fuel injectors 42 are controlled by controller 12 through lines 49, 16, 14, 23, 25 and 24.

The engine assembly includes means for determining at each time event measures of a set of engine parameters and providing a signal indicative of the measurements to the control unit 12 to be used in the engine state predictions. For example, air temperature and atmospheric pressure are sensed by sensors (not shown) and input into the controller 12 through lines 13 and 15. The positions of the IAC valve 28 and the EGR valve 36 are determined from the commands on command lines 16 and 14, or they may be measured directly using position sensors (not shown). The throttle position and manifold pressure are sensed by sensors 34 and 38 and input into the control unit 12 through lines 20 and 22. Engine speed is measured through the sensor 48, which detects the rotations of output shaft 46, and input into the control unit 12 through line 26. The engine coolant temperature is sensed by a sensor (not shown) and the oxygen content of the exhaust gas is sensed by sensor 19 and both measurements are input into the control unit 12 through lines 11 and 17. The sensors mentioned above are all standard sensors, a variety of which are readily available to those skilled in the art.

Figure 2:
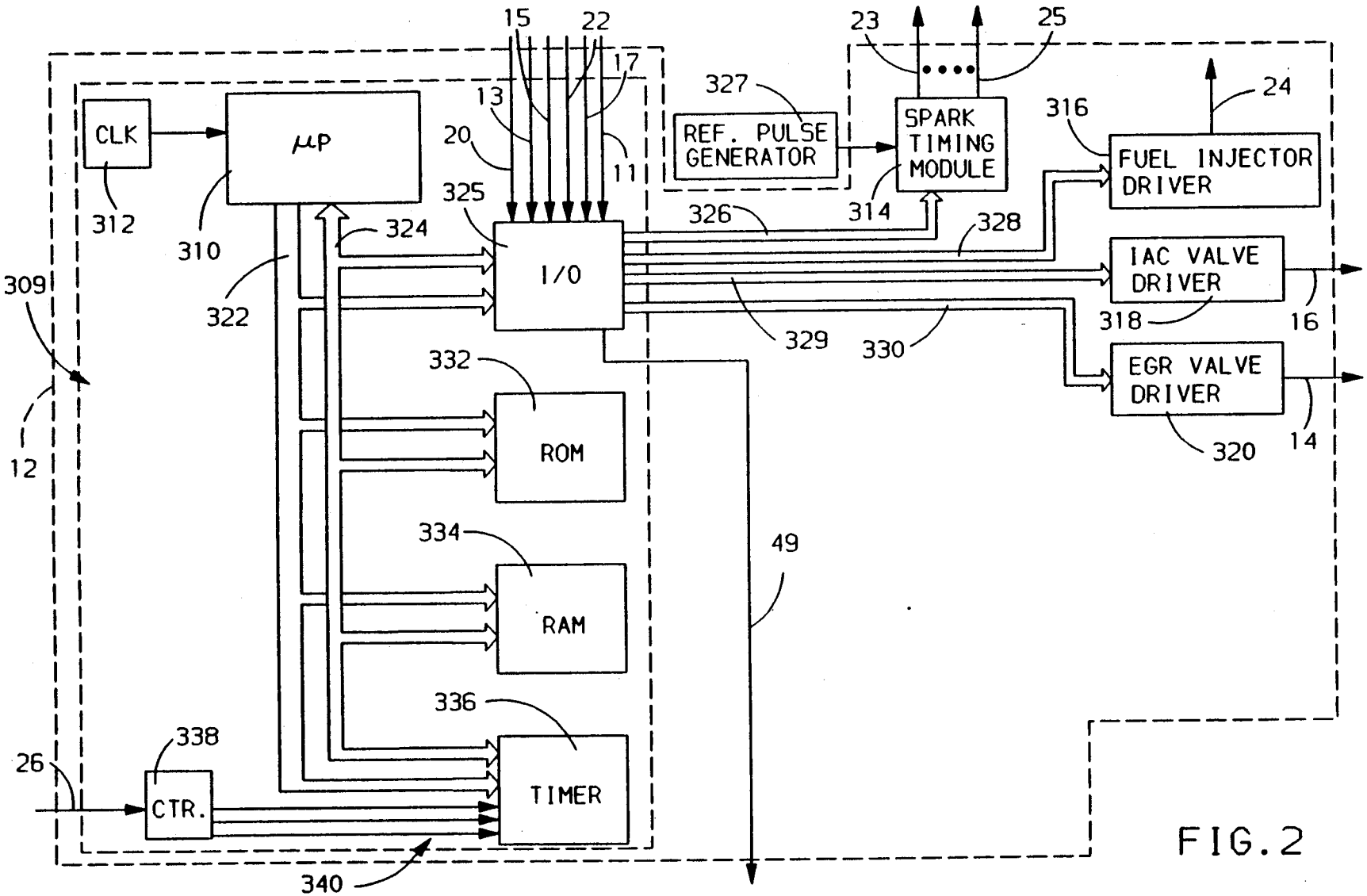
FIG. 2 is an example control unit of the type shown in FIG. 1.

The control unit 12 is a standard control unit easily implemented by one skilled in the art and an example control unit 12 is shown in FIG. 2. The example control unit 12 shown includes microprocessor 310, clock 312, I/O unit 325, interfaces 314, 316, 318 and 320 for controlling engine spark timing, fuel injection, IAC valve position and EGR valve position in response to microprocessor 310. Microprocessor 310 executes an engine control program implementing this invention with standard engine control functions. The control program is stored in ROM 332 and RAM 334 is used for temporary storage of program variables, parameter measurements and other data. Microprocessor 310 sends commands to I/O unit 325, ROM 332, RAM 334 and timer 336 through bus 322 and transfers information between the various units through bi-directional data bus 324.

The I/O unit 325 and the timer unit 336 comprise means for receiving the measurement signals for the measured engine parameters. Engine speed data from sensor 48 is fed, through line 26, to counter 338, which counts the rotations of the engine output shaft 46. The counter 338 provides the count information to timer 336 through lines 340. From the information provided by counter 338 and timer 336, microprocessor 310 can easily compute the engine speed (RPM) and store the information in RAM 334. Various other input signals are provided through the I/O unit 325. Equivalent functions to those of microprocessor 310, I/O unit 325, ROM 332, RAM 334 and timer 336, all shown within box 309, can be performed by a single chip microcomputer, such as Motorola TM microcomputer No. MC68HC11.

Spark timing and dwell commands may be determined by the microprocessor 310 (in accordance with this invention as described below) and those commands are provided to a standard spark timing module 14 through bus 326. Spark timing module 314 also receives engine position reference signals from a standard reference pulse generator 327 and controls the engine spark plugs through lines 23-25.

Buses 328, 329 and 330 provide commands from microprocessor 310 to interface units 316, 318 and 320, which are standard drivers for the engine fuel injection, idle air control valve and exhaust gas recirculation valve.

This invention can be used to predict various engine states at future engine events. The predicted engine states, such as manifold absolute pressure, mass air flow and engine speed are determined in response to a variety of engine parameters. The predicted values for these states may be used in place of measured values in conventional engine—powertrain controls to provide improved engine—powertrain control.

In one implementation of the invention to predict manifold absolute pressure, the control unit determines the measures of the engine parameters such as EGR valve position, IAC valve position, manifold pressure, engine speed, temperature, and atmospheric pressure and uses the measurements in the prediction-estimation process to determine an accurate prediction of manifold pressure at the time air and fuel enter the engine 44. Once an accurate prediction of manifold pressure at the time air and fuel enter the engine 44 is determined, the measure of mass airflow into the engine can be calculated through standard speed-density calculations. With the mass airflow calculated using the predicted manifold pressure, the fuel injectors 42 can be controlled through lines 24 so that a proper air-fuel ratio enters the engine 44. The mass airflow into the engine can also be used together with other engine parameters to determine the ignition timing for spark plugs 41 and 43.

Many engines do not have an IAC valve 28 or an EGR valve 36, but as will be explained below, their presence is not necessary for the successful implementation of the invention. Furthermore, the specific engine parameters that need to be taken into account for successful implementation of this invention vary depending upon which state this invention is being implemented to predict. For example, if manifold absolute pressure is being predicted, at least throttle position and manifold absolute pressure must be taken into account in calculating the predictions. Including other engine parameters in the calculations improves the accuracy of the predicted manifold absolute pressure measurement.

Figure 3:
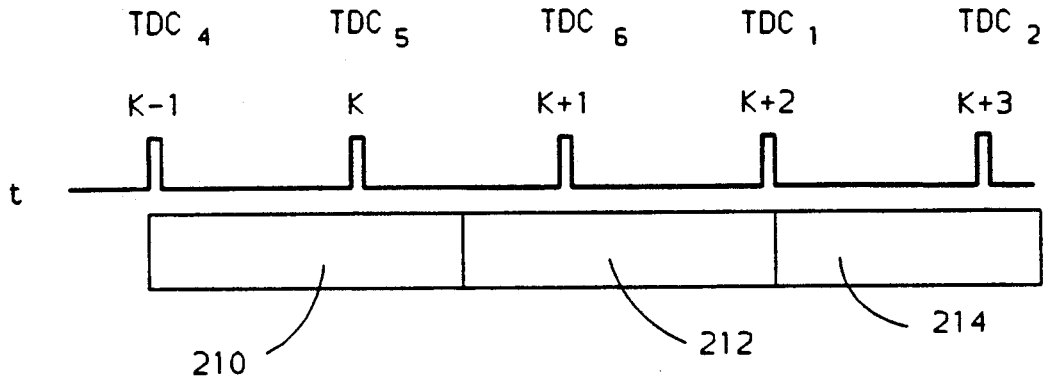
FIG. 3 is an engine timing diagram.

A more detailed description of a typical engine timing scheme can be understood with reference to the timing diagram shown in FIG. 3. The timing diagram shown is for a V6 engine. The times labeled $TDC_4$, $TDC_5$, $TDC_6$, $TDC_1$, and $TDC_2$ correspond to the times when the fourth, fifth, sixth, first, and second cylinders achieve top dead center position, respectively. In the example shown, each top dead center occurs 120 degrees of engine output shaft rotation after the previous cylinder achieves the top dead center position. In one implementation, each engine event may correspond to a cylinder achieving top dead center position. For example, if at the present engine event, k, cylinder 5 is at the top dead center position ($TDC_5$), then $TDC_4$ occurred at event $k-1$, $TDC_6$ will occur at event $k+1$, $TDC_1$ will occur at event $k+2$, $TDC_2$ will occur at event $k+3$, etc. Alternatively, any fixed point in the engine cycle may be chosen to correspond to the occurrence of an engine event. Blocks 210, 212, and 214 represent the power stroke, exhaust stroke, and intake stroke, respectively, for cylinder one.

In order to account for the computation and fuel delivery delays, each cylinder's fuel requirement must be calculated when the second preceding cylinder achieves the top dead center position, e.g., the fuel requirement for cylinder one must be calculated at the top dead center position of cylinder five. Using the computation of fuel for cylinder one as an example, the sensor measurements required to calculate the fuel for cylinder one are taken at $TDC_5$, the present engine event k. The fuel and air are delivered to cylinder one during the intake stroke 214. To compensate for the delays in this V6 system, manifold pressure is ideally predicted somewhere between 2 and 3 engine events in advance. Although in theory an optimal prediction point exists, it is difficult to determine. However, depending upon the characteristics of the system, it may be preferable to approximate and predict manifold pressure based on a weighted average of the predictions 2 and 3 engine events in advance, or in other systems a prediction 2 engine events in the future may be optimal.

Implementation of the prediction-estimation method for predicting future values of an engine state can be further explained with reference to FIG. 4. Block 66 represents the engine assembly whose parameters are measured by sensors 68 and used by the predictor-estimator 78. As can be seen by the arrangement of blocks 70, 72, and 76, the prediction-estimation method operates in a loop.

As will be explained, the prediction-estimation method is a dynamic process whose output depends upon previous measurements and estimations. For this reason, various parameters of the system must be initialized, during vehicle start-up or system reset. After initialization, estimations of the desired engine state, $X^e$ (X here represents the general engine state to be predicted, $X^e$ denoted an estimation of X and $X^p$ represents a prediction of X), are computed through blocks 70 and 72 in response to previously predicted values of the desired engine state, $X^p(k)$, and a weighted comparison of a previously predicted value of the desired engine state with an actual measured value of the desired engine state, X. New predictions of the desired engine state at the next engine event and R engine events ahead, $X^p(k+1)$ and $X^p(k+R)$, are determined at block 76 in response to the estimates at block 72, the measured engine parameters, and a set of fixed predetermined model parameters.

The number of engine events ahead, R, that is used depends on the specific engine state being predicted, and the specific engine system. For example, if manifold absolute pressure is predicted, typical values for R might include 1, 2, 3 and 4 depending upon the specific engine system.

The prediction of the desired state at R engine events in the future, $X^p(k+R)$, is the desired prediction result. The prediction of the desired state at the next engine event, $Xp(k+1)$, is for use in the estimation step to correct for error tendencies in the prediction model.

The coefficients used in the weighted comparison in block 70 are predetermined in block 62 in a test vehicle through a statistical optimization process such as Kalman filtering and scheduled, based upon two independent engine parameters, e.g., measured manifold absolute pressure and engine speed, at block 61. After the estimator correction coefficients are retrieved, they are used at block 70 in the weighted comparison of the predicted value of the desired engine state for engine event k and the measured value of the state. The weighted comparison may be done either as a separate step from determining the estimations or as part of the estimation determination step. The weighted comparison for the example where manifold absolute pressure is predicted can be described as the following function:

$$G_f(X^{err}),$$

where $X^{err}=X(k)=X^p(k)$. The model parameters are predetermined through statistical reduction of data taken from a test vehicle and scheduled at box 75.

Both the model parameters and correction coefficients are fixed and predetermined in a test vehicle. Because of the nonlinearity of the engine, the model parameters and correction coefficients are scheduled. The predetermination of the parameters and correction coefficients along with the scheduling of the same allows for the control system to have fast response to changing engine states. This is because when the engine changes states, new model parameters and correction coefficients are simply looked up from computer memory or interpolated from values in computer memory, eliminating the need for adaptive predictions and the slower response time accompanying adaptive systems (typically at least 200–300 events).

Figure 5:
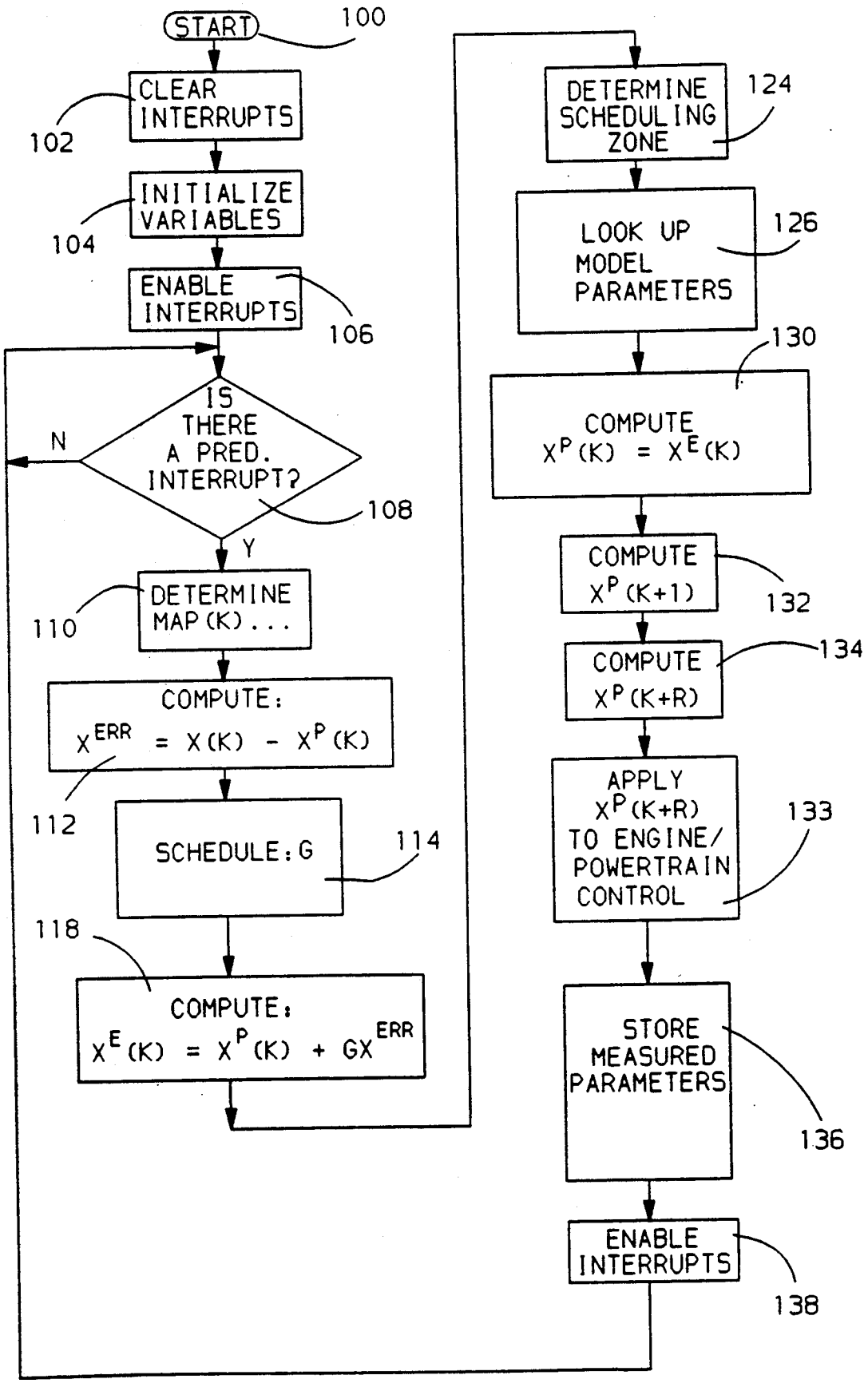
FIGS. 5, 6, and 7 are flow diagrams for computer implementations of the present invention.

FIG. 5 represents a computer flow diagram of a generic implementation of this invention to predict an engine state X, where X(k) is the measure of the engine state X at time k and $X^p(k+R)$ is the prediction of the engine state X at time $(k+R)$. Blocks 100, 102, 104, and 106 startup the system and initialize the variables. At block 108, the system checks for an interrupt signal, which is produced by the engine controller whenever it requires a new prediction. If there is an interrupt, the program proceeds into the prediction-estimation loop starting at block 110, where the set of engine parameters used in the prediction is determined through input from the measurement means and/or calculation as described above. The set of engine parameters used in the prediction comprises a vector U(k), where $$U(k) = \begin{pmatrix} u_1(k) \\ u_2(k) \\ \cdot \\ \cdot \\ \cdot \\ u_\epsilon(k) \end{pmatrix}, \text{ and}$$

where $u_1(k) \ldots u_\epsilon(k)$ are the past and present engine parameter measurements determined at block 110 and in computer memory. For example, $u_1(k)=TPS(k)$, $u_2(k)=TPS(k-1)$, etc., where TPS(k) is a measure of throttle position at event k and TPS(k−1) is a measure of throttle position at event k−1.

At block 112, the computer computes a value for predicted state error, $X^{err}$. At block 114 the estimator correction coefficients are scheduled and retrieved.

The estimator correction coefficients may be represented by a vector G, such that:

$$G = \begin{pmatrix} G_j \\ G_{j-1} \\ \cdot \\ \cdot \\ \cdot \\ G_0 \end{pmatrix}.$$

Implementation of statistical optimization of the estimator correction coefficients reveals that the coefficients G for a given engine operating point eventually achieve a virtual steady state. This allows the determination of G to be done off line, e.g., in a test vehicle, and the values for G to be programmed into ROM in the control unit. This method is favorable because the matrix equations required by block 62 become very extensive if many variables are used in the model, requiring more computer execution time than would normally be available in a production automotive engine controller.

At block 118, $X^e(k)$ is computed as:

$$X^e(k)=X^p(k)+GX^{err},$$

where:

$$X^e(k) = \begin{pmatrix} X^e(k-j) \\ X^e(k-j+1) \\ \cdot \\ \cdot \\ \cdot \\ X^e(k) \end{pmatrix}, \text{ and } X^p(K) = \begin{pmatrix} X^p(k-j) \\ X^p(k-j+1) \\ \cdot \\ \cdot \\ \cdot \\ X^p(k) \end{pmatrix},$$

and which is equivalent to the series of equations:

$$\begin{aligned} X^e(k-j) &= X^p(k-j) + G_jX^{err}, \\ X^e(k-j+1) &= X^p(k-j+1) + G_{j-1}X^{err}, \\ \cdot & \quad \cdot \quad \cdot \\ \cdot & \quad \cdot \quad \cdot \\ \cdot & \quad \cdot \quad \cdot \\ X^e(k) &= X^p(k) + G_0X^{err}. \end{aligned}$$

The computer determines the model parameter schedule zone utilizing two independent engine parameters at block 124. At block 126, the computer looks up the model parameters from ROM memory.

The model parameters used in the prediction step may be described as three different sets of parameters $\{a_1, a_2, \ldots a_{j+1}\}$, $\{c_1, c_2, \ldots c_\epsilon\}$, and $\{h_1\}$, and define matrices A, B, and C as follows:

$$A = \begin{pmatrix} 0 & 1 & 0 & \cdot & \cdot & \cdot & 0 \\ 0 & 0 & 1 & 0 & \cdot & \cdot & \cdot \\ \cdot & 0 & 0 & & \cdot & \cdot & \cdot \\ \cdot & \cdot & \cdot & & \cdot & 0 & \cdot \\ \cdot & \cdot & \cdot & & & 1 & 0 \\ 0 & \cdot & \cdot & & \cdot & 0 & 1 \\ a_1 & a_2 & \cdot & \cdot & \cdot & a_j & a_{j+1} \end{pmatrix} \begin{matrix} (1) \\ (2) \\ \cdot \\ \cdot \\ \cdot \\ \cdot \\ (j+1) \end{matrix},$$

$$B = \begin{pmatrix} 0 & \cdot & \cdot & \cdot & 0 \\ \cdot & & & & \cdot \\ \cdot & & & & \cdot \\ \cdot & & & & \cdot \\ 0 & & & & 0 \\ c_1 & \cdot & \cdot & \cdot & c_\epsilon \end{pmatrix} \begin{matrix} (1) \\ (2) \\ \cdot \\ \cdot \\ \cdot \\ (j+1) \end{matrix}, \text{ and } C = \begin{pmatrix} 0 \\ \cdot \\ \cdot \\ \cdot \\ 0 \\ h_1 \end{pmatrix}.$$

These sets of model parameters are predetermined through statistical regression of data taken from a test vehicle. The parameters $\{a_1, a_2, \ldots a_{j+1}\}$, $\{c_1, c_2, \ldots c_\epsilon\}$, and $h_1$ are the gain coefficients for finding $X^p(k+1)$.

The statistical regression process includes running the test vehicle in various states to obtain sets of engine parameter data measurements for each engine event k. Optimization problems are then set up to find the model parameters ($a_{fs}$, $c_{fs}$, and $h_{fs}$) for each engine state to minimize the following function:

$$\sum_{l=1}^{n-1} [w_1(l)(X(l+1) - X^M(l+1))]^2, \text{ and}$$

where n is the number of data observations for the specific engine state, $w_1(1)$ is a positive weighting constant chosen to improve model fit in critical areas to ensure statistical integrity of the model and may vary as a function of 1, and where:

$$X^M(l+1) = a_1X(l-j) + a_2X(l-j+1) + \ldots + a_{j+1}X(l) + c_1u_1(l) + c_2u_2(l) + \ldots + c_\epsilon u_\epsilon(l) + h_1.$$

One skilled in the art can easily perform the above statistical regression and determine the model parameters, therefore the determination of the model parameters will not be set forth in further detail here.

Internal combustion engines are typically nonlinear and the prediction step set forth below is a linear function with different sets of model parameters to approximate the engine at different operating points. The model parameters should therefore be scheduled for accurate predictions. Likewise, as mentioned above, the estimator corrections coefficients, G, should be scheduled. The scheduling may be done with reference to any two independent engine parameters, e.g. engine speed, RPM(k), and manifold pressure, MAP(k).

The scheduling of the model parameters may be done several different ways. One scheduling method is to use single schedules of parameters and estimator correction coefficients over defined ranges. Another scheduling method is to determine the parameters and estimator correction coefficients at different independent parameter engine operating points and to interpolate between the determined parameters to find a different set of parameters and estimator correction coefficients for each engine operating point. With either of these scheduling methods, the parameters may be retrieved from a three dimensional look-up table in computer memory based on engine speed and manifold pressure, or any other two independent engine parameters. Additionally, any other suitable scheduling method may be used.

$X^p(k)$ is computed at block 130 such that $X^p(k)=X^e(k)$. At block 132, $X^p(k+1)$ is computed according to the equation:

$$X^p(k+1)=AX^e(k)+BU(k)+C,$$

where $X^p(k+1)$ is the last row of $X^p(k+1)$.

At block 134, $X^p(k+R)$ is computed according to the equation:

$$X^p(k+R)=\alpha X^e(k)+\beta U(k)+\gamma,$$

where the three matrices $\alpha$, $\beta$, and $\gamma$, are defined as: $\alpha=A^R$, $\beta=A^{R-1}B+A^{R-2}B+\ldots+AB+B$, and $\gamma=[A^{R-1}+A^{R-2}+\ldots+A+I]C$. These matrices are easily determined by one skilled in the art and vary in form as the value for R varies.

The predicted engine state (or states if the above routine is run more than once, for different states) is used at block 133 for improved control of the vehicle engine—powertrain.

At block 136, the computer prepares for the next engine event by storing engine parameters which will be used for the next iteration of the prediction calculation. At block 138 the interrupts are enabled and the program loops back to block 108. The limits on the estimator correction coefficients scheduled at block 114 are as described below.

In the above example, X may be any predictable engine state, including manifold absolute pressure (MAP), mass air flow into the engine (MAF) and engine speed (RPM) Any of these states may be predicted according to FIG. 5 by substituting MAP, MAF, or RPM into the routine described above, and determining the model parameters and correction coefficients in the test vehicle in correlation with the desired state to be predicted. If desired, more than one state may be predicted by implementing the prediction portion of the control routine of FIG. 5 once for every state to be predicted. In cases where more than one state is predicted, there must be a set of model parameters and correction coefficients for each state being predicted.

Figure 6:
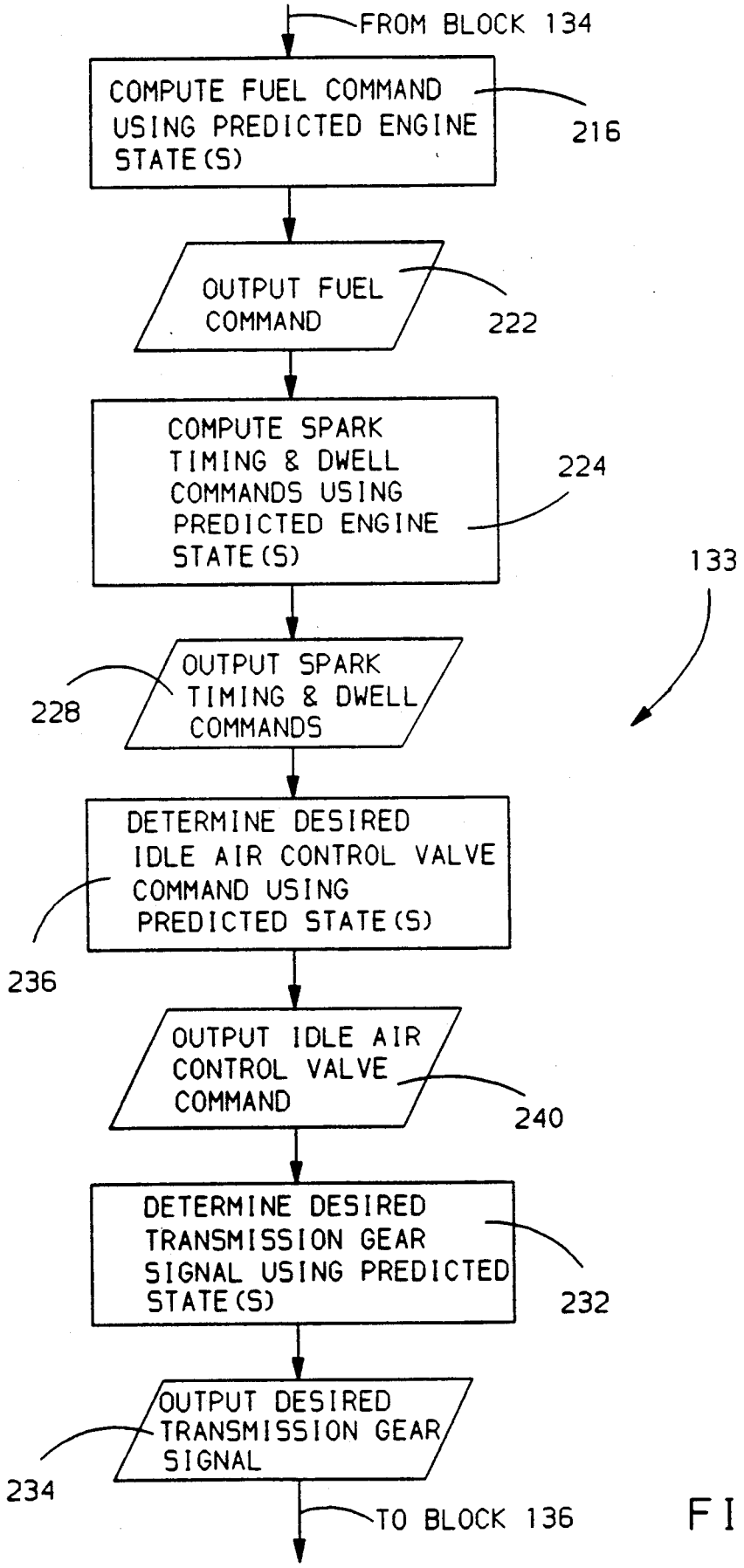

Referring to FIG. 6, block 216 illustrates that this invention may be implemented with typical fuel control, such as speed-density fuel control, using the predicted values for the predicted engine states in place of the actual measurements of those states. No other modification needs to be made to the fuel control system A simple straight-forward substitution of the predicted value of, for example, manifold absolute pressure in place of the measured value conventionally used, provides improved air-fuel ratio control because the predicted value is a more accurate indication of manifold absolute pressure at the time the cylinder is actually fueled.

Any of the engine states used in air-fuel ratio control which are predictable, may be predicted according to this invention and used in the air-fuel ratio control as a straight-forward substitution for the conventionally measured value. Such engine states may include manifold absolute pressure, mass air flow into the engine, and/or engine speed. Implementations may include using one predicted state, such as manifold absolute pressure, in combination with measured states or with other predicted states.

At block 222, the fuel command determined at block 216 using predicted states is output to control the engine fuel injection in a conventional manner well-known to those skilled in the art.

Block 224 illustrates that this invention may be implemented with typical spark control using predictions of engine states similarly to how the predictions are used for air-fuel ratio control. More specifically, a straight-forward substitution of the predicted value of the desired engine state in place of the conventional measured value is used to obtain the spark timing and dwell commands (or equivalents if a different type of system is used) in a manner well-known to those skilled in the art. At block 228, the spark timing and dwell commands are output to a standard engine spark timing control module to control engine spark timing.

Block 236 illustrates that this invention may also be implemented with typical idle air control valve control using predictions of engine states similarly to how predictions are used for air-fuel ratio control. As described above, a straight-forward substitution of the predicted value of the desired engine state in place of the conventional measured value is used to determine an idle air control valve command. At block 240, the idle air control valve command is output to control the engine idle air control valve in a manner well-known to those skilled in the art.

Block 232 illustrates that this invention may also be implemented with electronic transmission control. A straight-forward substitution of the predicted value of the desired engine state in place of the conventional measured value is used to determine a transmission gear command. For example, a prediction of manifold absolute pressure can be used as an indication of vehicle load and, with other signals such as measured engine speed, used as an input to a transmission shift pattern function generator. The resultant transmission gear command is output at block 234. This example implementation may be easily achieved by one skilled in the art.

The above example engine—powertrain controls may be easily implemented by those skilled in the art without further elaboration herein. Furthermore, the above engine—powertrain control examples are not the only engine—powertrain controls with which this invention may be implemented. The possible applications of engine—powertrain control in response to predicted engine states are endless and new applications which fall within the scope of this invention may occur to those skilled in the art.

Referring again to FIG. 4, blocks 62, 71, and 73 represent one method of how the estimator correction coefficients G may be predetermined in a test vehicle: Kalman filtering.

After the model parameters are found, the invention is implemented in a control system in the test vehicle in a similar manner as explained above. The difference is that blocks 62, 71, and 73 are added to the control routine for computing the estimator correction coefficients, which are now a function of time and will be represented by the vector G(k) where:

$$G(k) = \begin{pmatrix} G_j(k) \\ G_{j-1}(k) \\ \cdot \\ \cdot \\ \cdot \\ G_0(k) \end{pmatrix}.$$

After each estimation, the estimation error covariances (error variances dependent upon multiple variables) are updated at block 71 and after each prediction, the prediction error covariances are updated at block 73. Based upon the estimation and prediction error covariances, the correction coefficients are updated at block 62. The correction coefficients are then sorted into schedules based upon two independent engine parameters. More particularly, during initialization of the system, variables representing the desired state measurement error variance, Γ, and the process noise covariance, Q, are input into the controller. One example for the matrix Q is:

$$Q = \begin{pmatrix} q_1 & 0 & \cdot & \cdot & \cdot & 0 \\ 0 & q_2 & & & & \cdot \\ \cdot & 0 & \cdot & & & \cdot \\ \cdot & \cdot & & \cdot & & \cdot \\ \cdot & \cdot & & & \cdot & 0 \\ 0 & 0 & \cdot & \cdot & 0 & q_{j+1} \end{pmatrix},$$

where:

$q_1 = q_2 = \ldots = q_{j+1}$ = error variance of the desired state model computed in the above mentioned statistical reduction of data used to determine the model parameters. In general, Q may be any positive semi-definite matrix. One choice for Γ is the noise from A/D conversion quantization error.

At block 62, G(k) is computed according to the equation:

$$G(k) = Z(k)L^T/(LZ(k)L^T + \Gamma),$$

where Z(k) is the state prediction error covariance at time k, L a matrix such that:

$$L = [0 \ldots 1],$$

with the "1" in the (j+1)st position of the matrix, and $L^T$ is the transpose of L (a column matrix with all zeros except for a "1" in the (j+1)st position). At block 72, $X^e(k)$ is computed using G(k), such that:

$$X^e(k) = X^p(k) + G(k)(X(k) - X^p(k)).$$

At block 71, the state estimator error covariance S(k) is updated where:

$$S(k) = (I - G(k)L)Z(k),$$

where I is the following identity matrix:

$$I = \begin{pmatrix} 1 & 0 & \cdot & \cdot & \cdot & 0 \\ 0 & 1 & & & & \cdot \\ \cdot & & \cdot & & & \cdot \\ \cdot & & & \cdot & & \cdot \\ \cdot & & & & \cdot & 0 \\ 0 & \cdot & \cdot & \cdot & 0 & 1 \end{pmatrix} \begin{matrix} (1) \\ (2) \\ \cdot \\ \cdot \\ \cdot \\ (j+1) \end{matrix}$$

The prediction step at box 76, where $X^p(k+1)$ is computed is the same as explained above. At block 73, the state prediction error covariance Z(k) is updated such that:

$$Z(k+1) = AS(k)A^T + Q,$$

where $A^T$ is the transpose of A.

Running the test vehicle in an engine operating range around a particular engine operating point for several seconds, e.g., 1000 cycles, will result in stabilization of vector G(k) for that particular engine operating range. The vector G for that particular engine operating range can then be set equal to G(k), where k=1000.

Kalman filtering is only one method of determining G. Any group of constants that tend to lessen the error in the estimates can be chosen for G. The limitation for the system is that the roots of the polynomial f(z), described below, must be within the unit circle The polynomial f(z) is the determinant of a matrix M, defined as:

$$M = zI - A + GLA.$$

The above described example is illustrated with reference to predicting manifold absolute pressure, but can easily be adapted by one skilled in the art to predict any engine state that can be mathematically modeled as above.

It should be noted that any of the engine parameters may be treated as time function variables. In other words, the present and past values of any of the engine parameters may be used, but the balance between simplicity and accuracy favors the specific implementations set forth herein. It is also noted that with reference to the above described illustration, one skilled in the art can easily alter the vehicle parameters taken into account in the predictions by adding and/or removing different vehicle parameter measurements to and from the vector U(k) and altering the model parameter matrices A, B, and C to take these different vehicle parameters into account.

EXAMPLE 1

Referring again to FIG. 5, in a preferred implementation of the invention the desired state is manifold absolute pressure which is predicted two engine events in the future, e.g., R =2. This implementation takes into account engine speed, atmospheric pressure and the IAC and EGR valve positions. The measured engine parameters may be described by vector U(k) as:

$$\begin{pmatrix} TPS(k) \\ TPS(k-1) \\ \cdot \\ \cdot \\ \cdot \\ TPS(k-e) \end{pmatrix}$$

-continued $$U(k) = \begin{vmatrix} RPM(k) \\ RPM(k-1) \\ \cdot \\ \cdot \\ \cdot \\ RPM(k-s) \\ IAC(k) \\ EGR(k) \end{vmatrix}, \quad \begin{vmatrix} T(k) \\ ATM(k-1) \\ \cdot \\ \cdot \\ \cdot \\ ATM(k-g) \end{vmatrix}$$

This example sets: e=3, g=0, j=3, s=3. At block 110, MAP(k), RPM(k), TPS(k), IAC(k), EGR(k), T(k), and ATM(k), are determined. At block 112, $X^{err}$ is manifold pressure error, $MAP^{err}$, where $MAP^{err}=MAP(k)-MAP^{p}(k)$. At block 118, $MAP^{e}(k)$, $MAP^{e}(k-1)$, $MAP^{e}(k-2)$, and $MAP^{e}(k-3)$ are computed with the resultant equations of:

$$\begin{aligned} MAP^{e}(k) &= MAP^{p}(k) + G_0 MAP^{err}, \\ MAP^{e}(k-1) &= MAP^{p}(k-1) + G_1 MAP^{err}, \\ MAP^{e}(k-2) &= MAP^{p}(k-2) + G_2 MAP^{err}, \\ MAP^{e}(k-3) &= MAP^{p}(k-3) + G_3 MAP^{err}. \end{aligned}$$

At block 124, the model parameter schedule zone is determined utilizing RPM(k) and MAP(k). At block 130, $MAP^{p}(k)$, $MAP^{p}(k-1)$ and $MAP^{p}(k-2)$ are computed such that $MAP^{p}(k)=MAP^{e}(k)$, $MAP^{p}(k-1)=MAP^{e}(k-1)$, and $MAP^{p}(k-2)=MAP^{e}(k-2)$. At block 132, $MAP^{p}(k+1)$ is computed according to the equation:

$$\begin{aligned} MAP^{p}(k+1) = {} & a_1 MAP^{e}(k-3) + a_2 MAP^{e}(k-2) + \\ & a_3 MAP^{e}(k-1) + a_4 MAP^{e}(k) + c_1 TPS(k) + c_2 TPS(k-1) + \\ & c_3 TPS(k-2) + c_4 TPS(k-3) + c_5 RPM(k) + c_6 RPM(k-1) + \\ & c_7 RPM(k-2) + c_8 RPM(k-3) + c_9 IAC(k) + c_{10} EGR(k) + \\ & c_{11} T(k) + c_{12} ATM(k) + h_1, \text{ and} \end{aligned}$$

at block 134, $MAP^{p}(k+2)$ is computed according to the equation:

$$\begin{aligned} MAP^{p}(k+2) = {} & a_1 a_4 MAP^{e}(k-3) + (a_1 + a_2 a_4)\, MAP^{e}(k-2) + \\ & (a_2 + a_3 a_4)\, MAP^{e}(k-1) + (a_3 + a_4^2)\, MAP^{e}(k) + \\ & c_1[1 + a_4] TPS(k) + c_2[1 + a_4] TPS(k-1) + \\ & c_3[1 + a_4] TPS(k-2) + c_4[1 + a_4] TPS(k-3) + \\ & c_5[1 + a_4] RPM(k) + c_6[1 + a_4] RPM(k-1) + \\ & c_7[1 + a_4] RPM(k-2) + c_8[1 + a_4] RPM(k-3) + \\ & c_9[1 + a_4] IAC(k) + c_{10}[1 + a_4] EGR(k) + \\ & c_{11}[1 + a_4] T(k) + c_{12}[1 + a_4] ATM(k) + h_1[1 + a_4]. \end{aligned}$$

The parameters stored at block 136 are TPS(k−2), TPS(k−1), TPS(k), RPM(k−2), RPM(k−1), and RPM(k).

Further examples of systems implementing this invention are described below.

EXAMPLE 2

For a more basic implementation of the invention useful for predicting manifold absolute pressure (MAP) R engine events ahead, the time function variables used are throttle position (TPS(k−f)) and predicted values of the desired engine state, ($MAP^{p}(k-f)$), where, as above, k is the current engine event and f is an integer at least zero. To simplify explanation, a vector P(k) is defined. Vector P(k) represents previous measurements of throttle position and here vector $X^{p}(k)$ represents previous predictions of the desired engine state, here manifold absolute pressure, $MAP^{p}$, e.g., $$P(k) = \begin{pmatrix} TPS(k-1) \\ \cdot \\ \cdot \\ \cdot \\ TPS(k-e) \end{pmatrix}, \text{ and } X^{p}(K) = \begin{pmatrix} MAP^{p}(k-j) \\ MAP^{p}(k-j+1) \\ \cdot \\ \cdot \\ \cdot \\ MAP^{p}(k) \end{pmatrix}.$$

where e and j are predetermined integers which are system constants, and k is the current engine event. During initialization, the vectors P(k) and $X^{p}(k)$ are given values of throttle positions and the predicted values of the desired engine state typically found during engine idle. These values can be stored in a system ROM.

Figure 4:
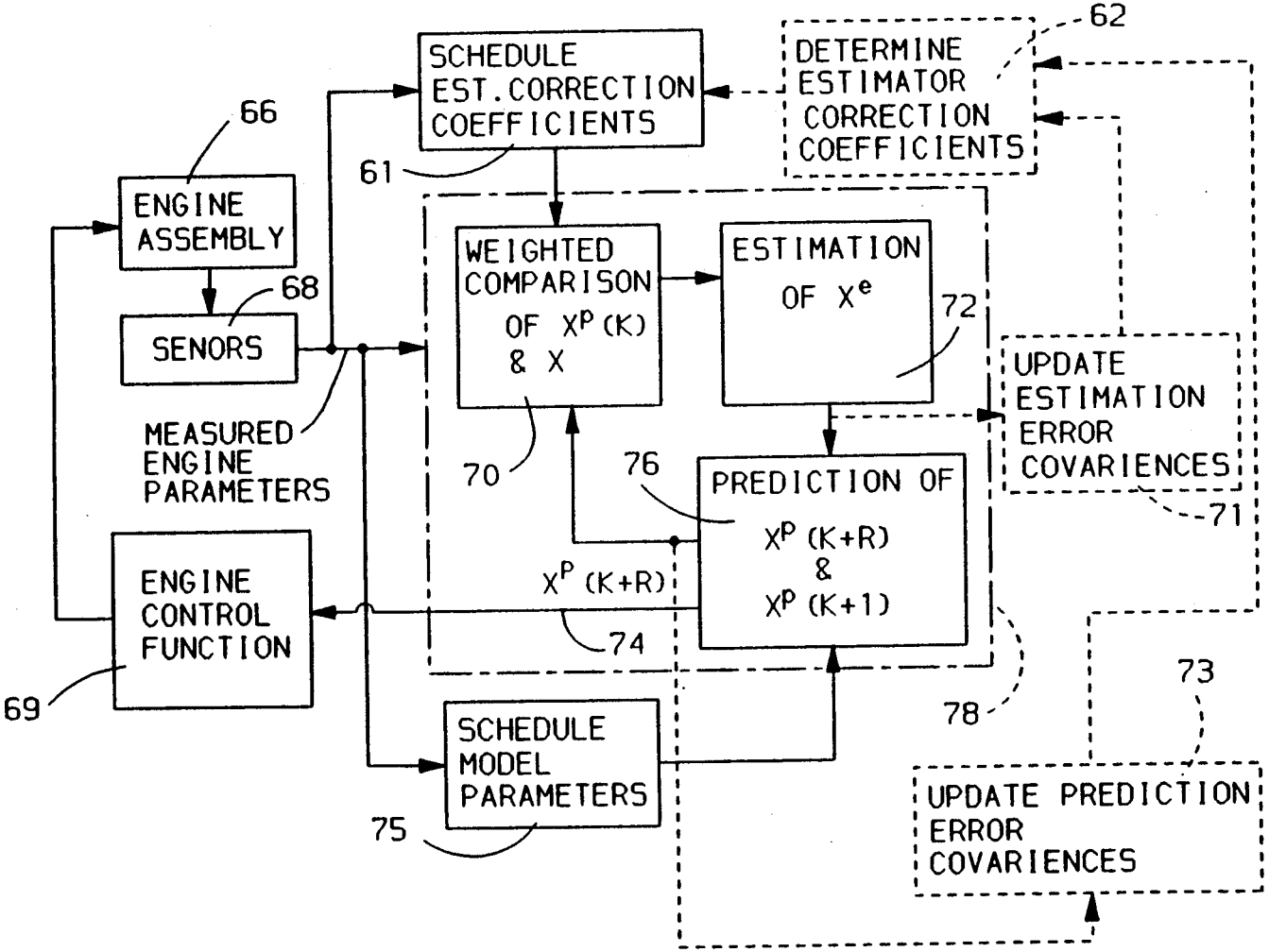
FIG. 4 is a schematic diagram showing the prediction-estimation method implemented by the present invention.

The system then enters the prediction-estimation loop where it first measures the present engine parameters, here: throttle position, TPS(k), engine speed, RPM(k), manifold pressure, MAP(k), and temperature, T(k), block 68, FIG. 4. The past and present measures of measured engine parameters can be expressed as a vector U(k), e.g., $$U(k) = \begin{pmatrix} TPS(k) \\ P(k) \\ RPM(k) \\ T(k) \end{pmatrix}.$$

The set of estimator correction coefficients is then retrieved from ROM or RAM depending upon the implementation of the system. The estimator correction coefficients are scheduled at block 61, e.g., found from a three dimensional look-up table in ROM based upon two independent engine parameters, preferably engine speed and manifold pressure. The weighted comparison (block 70) for the example where manifold absolute pressure is predicted can be described as the following function:

$$G_f(MAP(k) - MAP^{p}(k)).$$

The estimation of the desired engine state, here $MAP^{e}(k-f)$, may be described in vector notation by a vector $X^{e}(k)$, e.g., $$X^e(K) = \begin{pmatrix} MAP^e(k-j) \\ MAP^e(k-j+1) \\ \cdot \\ \cdot \\ \cdot \\ MAP^e(k) \end{pmatrix}.$$

Boxes 70 and 72 define vector $X^e(k)$ according to the following vector equation:

$$X^e(k) = X^p(k) + G(MAP(k) - MAP^p(k)),$$

which is equivalent to the series of equations:

$$\begin{aligned} MAP^e(k-j) &= MAP^p(k-j) + G_j(MAP(k) - MAP^p(k)), \\ MAP^e(k-j+1) &= MAP^p(k-j+1) + G_{j-1}(MAP(k) - MAP^p(k)), \\ &\cdot \\ &\cdot \\ &\cdot \\ MAP^e(k) &= MAP^p(k) + G_0(MAP(k) - MAP^p(k)). \end{aligned}$$

The parameters $\{a_1, a_2, \ldots a_{j+1})$, $(c_1, c_2, \ldots c_{e+3})$, and $h_1$ are the gain coefficients for finding $MAP^p(k+1)$ and comprise vectors A, B and C, which may also be scheduled with reference to any two independent engine parameters, e.g., engine speed, RPM(k), and manifold pressure, MAP(k).

After the model parameters are retrieved, at block 75, the predicted manifold absolute pressures for the next engine event and for the k+R engine event, comprising the vectors $X^p(k+1)$ and $X^p(k+R)$, are determined at block 76 according to the following vector equations:

$$X^p(k+1) = AX^e(k) + BU(k) + C, \text{ and}$$

$$X^p(k+R) = \alpha X^e(k) + \beta U(k) + \gamma,$$

which, for $X^p(k+1)$, is equivalent to the group of equations:

$$\begin{aligned} MAP^p(k-j+1) &= MAP^e(k-j+1), \\ MAP^p(k-j+2) &= MAP^e(k-j+2), \\ &\cdot \\ &\cdot \\ &\cdot \\ MAP^p(k) &= MAP^e(k), \\ MAP^p(k+1) &= a_1 MAP^e(k-j) + a_2 MAP^e(k-j+1) + \ldots + \\ &\quad a_{j+1} MAP^e(k) + c_1 TPS(k) + c_2 TPS(k-1) + \ldots + \\ &\quad c_{e+2} RPM(k) + c_{e+3} T(k) + h_1, \text{ and} \end{aligned}$$

for the last row of $X^p(k+R)$, is equivalent to the following equation:

$$\begin{aligned} MAP^p(k+R) &= \alpha_1 MAP^e(k-j) + \alpha_2 MAP^e(k-j+1) + \ldots + \\ &\quad \alpha_{j+1} MAP^e(k) + \beta_1 TPS(k) + \beta_2 TPS(k-1) + \ldots + \\ &\quad \beta_{e+2} RPM(k) + \beta_{e+3} T(k) + \gamma_1, \end{aligned}$$

where $\alpha_f$ is the element in the last row and f'th column of $\alpha$, $\beta_f$ is the element in the last row and f'th column of $\beta$, and $\gamma_1$ is the last element in $\gamma$.

In this example, $MAP^p(k+R)$ is the predicted value of the desired state and can be used to schedule fueling as is normally done with the measured value of MAP(k) in a speed-density system. Note that if R=1 then $\alpha$=A, $\beta$=B and $\gamma$=C and, according to the equations above, $X^p(k+1)$ equals $X^p(k+R)$ Using predictions of manifold absolute pressure eliminates the need for other transient fueling schemes and offers the benefit of reduced transient fueling errors for speed-density systems, resulting in decreased emissions while maintaining high performance driveability. Block 69 illustrates that the predicted engine state (here MAP) or states are used in determining engine control functions that are applied to engine assembly 66.

After the $X^p(k+1)$ and $X^p(k+R)$ are determined, the engine parameters for the next engine event are measured and a new estimate is made at blocks 70 and 72. The system then repeats the steps of estimation and prediction in a loop.

EXAMPLE 3

A system similar to EXAMPLE 2 may include one or more of the additional engine parameters when predicting the desired engine state: idle air control valve position (IAC(k)), exhaust gas recirculation valve position (EGR(k)), and atmospheric pressure (ATM(k)). The additional engine parameters used are included in vector U(k) and vector B includes correlating model parameters $c_f$, $c_{f+1}$, and/or $c_{f+2}$.

EXAMPLE 4

In certain engine systems it is preferable to take into account past measures of engine speed, RPM(k−f). It has been found that taking past measures of engine speed into account increases the accuracy of the manifold absolute pressure prediction during certain engine conditions. To consider past measures of engine speed, the past measurements must be initialized and included in vectors P(k) and U(k), where:

$$U(k) = \begin{pmatrix} TPS(k) \\ TPS(k-1) \\ \cdot \\ \cdot \\ \cdot \\ TPS(k-e) \\ RPM(k) \\ RPM(k-1) \\ \cdot \\ \cdot \\ \cdot \\ RPM(k-s) \\ IAC(k) \\ EGR(k) \\ T(k) \\ ATM(k-1) \\ \cdot \\ \cdot \\ \cdot \\ ATM(k-g) \end{pmatrix},$$

where s is a system constant.

Additionally, the model parameters include gain factors $c_f \ldots c_{f+s}$ and $d_f \ldots d_{f+s}$, which are included in matrix B and are multiplied by the past measurements of engine speed, RPM(k−f), in the calculation of the model predictions $X^p(k+1)$.

EXAMPLE 5

It may be desirable in a given system to take mass airflow measurements into account when determining engine fuel requirements. For example, mass airflow may be measured and used as a parameter in predicting manifold absolute pressure. Mass airflow can also be predicted similar to the prediction of manifold absolute pressure. Patent application U.S. Ser. No. 653,931, mentioned above, discloses a method for predicting mass airflow, relevant portions of which are also set forth below. Whether mass airflow is predicted or measured, the system may alternatively run like a typical fast-response system with the improvement of a prediction of manifold absolute pressure available to be taken into account to determine fuel scheduling, spark timing, idle air control, and/or electronic transmission control.

Figure 7:
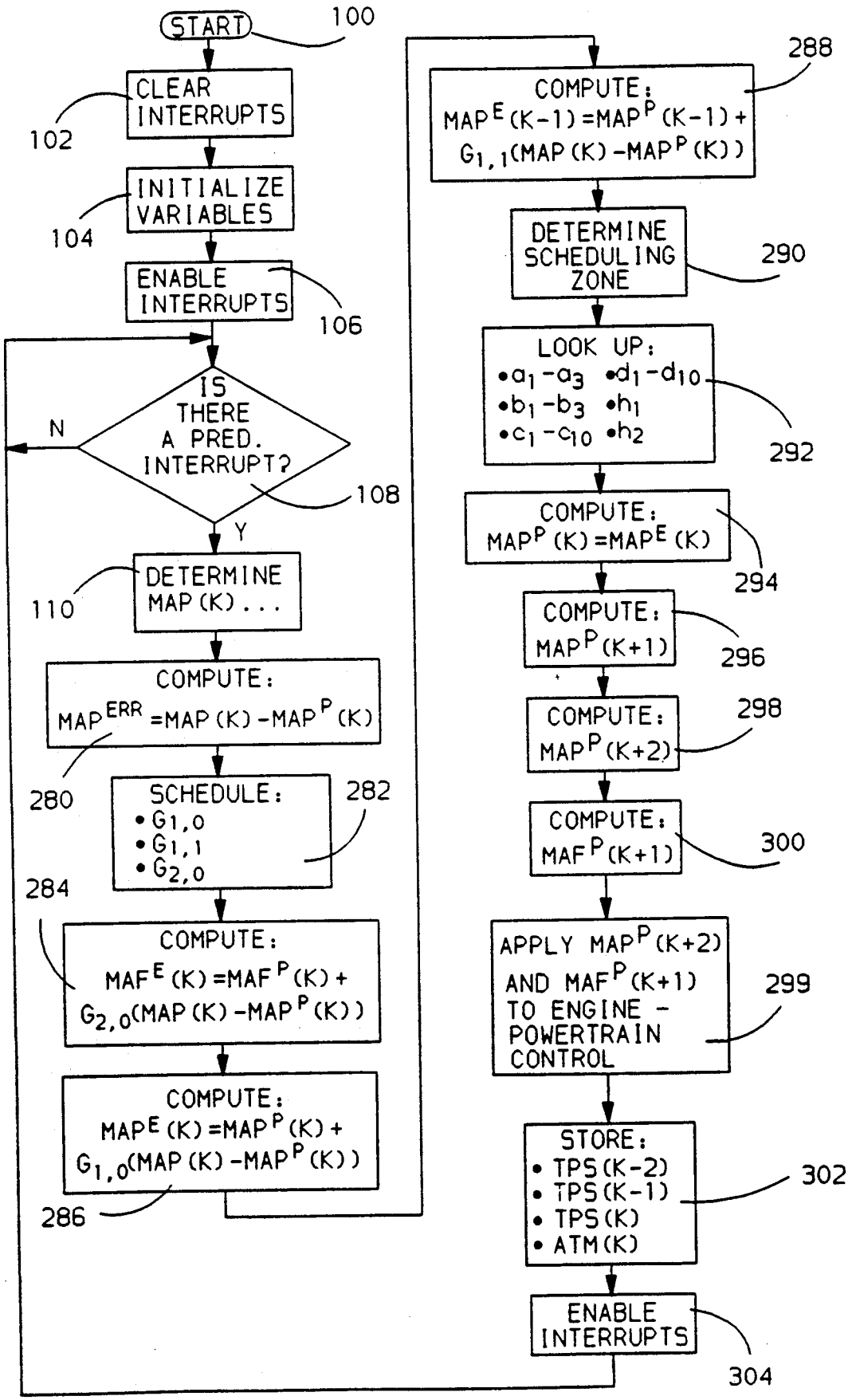

The computer flow diagram in FIG. 7 illustrates a preferred implementation of this invention in which mass airflow into the engine is estimated and the estimates are used to predict manifold absolute pressure R steps ahead (here R=2). The computer starts at block 100 and performs the steps through block 280 as described above with reference to FIG. 5. At block 282, the computer schedules the estimator correction coefficients. For this implementation, the estimator correction coefficients comprise a vector G, as follows:

$$G = \begin{pmatrix} G_{1,j} \\ G_{1,j-1} \\ \cdot \\ \cdot \\ \cdot \\ G_{1,0} \\ G_{2,i} \\ G_{2,i-1} \\ \cdot \\ \cdot \\ \cdot \\ G_{2,0} \end{pmatrix};$$

where i is a system constant (in the example below i=0 and j=1), $G_{1,f}$ represents the predicted manifold absolute pressure error correction coefficients and $G_{2,f}$ represents the predicted mass airflow error correction coefficients G is determined from a method such as Kalman filtering as described above taking into account the mass airflow model parameters.

At block 284, mass air flow is estimated from predicted mass air flow ($MAF^p$), G and $MAP^{err}$. In general $X^e(k)$ and $X^p(k)$ include manifold pressure and mass airflow estimations and predictions as follows:

$$X^p(K) = \begin{pmatrix} MAP^p(k-j) \\ MAP^p(k-j+1) \\ \cdot \\ \cdot \\ \cdot \\ MAP^p(k) \\ MAF^p(k-i) \\ MAF^p(k-i+1) \\ \cdot \\ \cdot \\ \cdot \\ MAF^p(k) \end{pmatrix};$$

$$X^e(K) = \begin{pmatrix} MAP^e(k-j) \\ MAP^e(k-j+1) \\ \cdot \\ \cdot \\ \cdot \\ MAP^e(k) \\ MAF^e(k-i) \\ MAF^e(k-i+1) \\ \cdot \\ \cdot \\ \cdot \\ MAF^e(k) \end{pmatrix}.$$

The calculation of the manifold absolute pressure and mass airflow estimations comprising vector $X^e(k)$ generally follows the following equation:

$$X^e(k) = X^p(k) + G(MAP(k) - MAP^p(k)).$$

Blocks 284, 286, and 288 perform these calculations to determine $MAF^e(k)$, $MAP^e(k)$, and $MAP^e(k-1)$, respectively, for this example.

Moving to block 290, the computer determines the parameter scheduling zone as described above and looks up the model parameters at block 292. Because both manifold absolute pressure and mass airflow are predicted, model parameters for both predictions are required. The model parameters generally include $\{a_1, a_2, \ldots a_{i+j+2}\}$, $\{c_1, c_2, \ldots c_0\}$, and $h_1$, the prediction manifold absolute pressure parameters and $\{b_1, b_2, \ldots b_{1+j+2}\}$, $\{d_1, d_2, \ldots d_0\}$, and $h_2$, the prediction mass airflow parameters. The model parameters comprise the matrices A, B, and C as follows:

$$A = \left(\begin{array}{cccccccccccccc} 0 & 1 & 0 & \cdot\cdot & 0 & 0 & 0 & \cdot & \cdot & \cdot\cdot & \cdot & 0 \\ 0 & 0 & 1 & 0 & \cdot & 0 & \cdot & 0 & \cdot & \cdot & \cdot\cdot & \cdot \\ \cdot & \cdot & 0 & \cdot & \cdot & \cdot & \cdot & \cdot & \cdot & \cdot & \cdot & \cdot \\ \cdot & \cdot & & & 0 & \cdot & \cdot & \cdot & \cdot & \cdot & \cdot & \cdot \\ \cdot & \cdot & & 0 & 1 & 0 & \cdot & \cdot & \cdot & \cdot & \cdot & \cdot \\ 0 & \cdot & \cdot & \cdot & 0 & 1 & 0 & 0 & \cdot & \cdot & 0 & 0 \\ a_1 & a_2 & \cdot & \cdot & a_j & a_{j+1} & a_{j+2} & a_{j+3} & \cdot & \cdot & \cdot & a_{j+i+2} \end{array}\right) \begin{array}{l} (1) \\ (2) \\ \cdot \\ \cdot \\ \cdot \\ \cdot \\ (j+1) \end{array},$$

$$\left(\begin{array}{cccccccccccc} 0 & 0 & \cdot & \cdot & 0 & 0 & 0 & 1 & 0 & \cdot\cdot & 0 & 0 \\ 0 & 0 & \cdot & \cdot & 0 & \cdot & 0 & 0 & 1 & 0 & \cdot & \cdot \\ \cdot & \cdot & \cdot & & \cdot & \cdot & \cdot & 0 & 0 & \cdot & \cdot & \cdot \\ \cdot & \cdot & & \cdot & \cdot & \cdot & \cdot & \cdot & & & \cdot & \cdot \\ \cdot & \cdot & & & \cdot & \cdot & \cdot & \cdot & & & \cdot & 0 \\ 0 & \cdot & & & 0 & 0 & 0 & 0 & \cdot & \cdot & 0 & 1 \\ b_1 & b_2 & \cdot & \cdot & b_j & b_{j+1} & b_{j+2} & b_{j+3} & \cdot & \cdot & \cdot & b_{j+i+2} \end{array}\right) \begin{array}{l} (j+2) \\ \cdot \\ \cdot \\ \cdot \\ \cdot \\ \cdot \\ (j+i+2) \end{array}$$

-continued $$B = \begin{pmatrix} 0 & \cdots & 0 \\ \cdot & & \cdot \\ \cdot & & \cdot \\ \cdot & & \cdot \\ 0 & & 0 \\ c_1 & \cdots & c_o \\ 0 & \cdots & 0 \\ \cdot & & \cdot \\ \cdot & & \cdot \\ \cdot & & \cdot \\ 0 & \cdots & 0 \\ d_1 & \cdots & d_o \end{pmatrix} \begin{matrix} (1) \\ (2) \\ \cdot \\ \cdot \\ \cdot \\ (j+1) \\ (j+2) \\ \cdot \\ \cdot \\ \cdot \\ \cdot \\ (j+i+2) \end{matrix}, \text{ and } C = \begin{pmatrix} 0 \\ \cdot \\ \cdot \\ \cdot \\ \cdot \\ h_1 \\ 0 \\ \cdot \\ \cdot \\ \cdot \\ 0 \\ h_2 \end{pmatrix},$$

where 0 is an integer and generally represents the number of engine parameter variables used in the model. The model parameters are determined from data taken in a test vehicle as described above, where an optimization problem for mass airflow that parallels the manifold absolute pressure optimization problem is used. For example, the optimization problem should minimize the following function for $b_j$s, $d_j$s, and $h_2$:

$$\sum_{l=1}^{n-1} [w_2(l)(MAF(l+1) - MAF^M(l+1))]^2,$$

where n is the number of data observations for the specific engine state, $w_2(1)$ is a positive weighting constant chosen to improve model fit in critical areas and to ensure statistical integrity of the model and may vary as a function of 1, and where:

$$MAF^M(l+1) = b_1MAP(l-j) + b_2MAP(l-j+1) + \ldots + b_{j+1}MAP(l) + b_{j+2}MAF(l-i) + b_{j+3}MAF(l-i+1) + \ldots + b_{j+i+2}MAF(l) + d_1TPS(l) + d_2TPS(l-1) + \ldots + d_{o-1}RPM(l) + d_oT(l) + h_2.$$

One skilled in the art can easily perform the statistical regression of data and determine the model parameters.

Matrices $\alpha$, $\beta$, and $\gamma$ are defined as described above, where the j+1st row of $\alpha$ comprises $\alpha_1 \ldots \alpha_{j+i+2}$, the j+1st row of $\beta$ comprises $\beta_1 \ldots \beta_0$, and the j+1st row of $\gamma$ comprises $\gamma_1$.

After the model parameters are retrieved at block 292, blocks 294, 296, and 300 compute the predictions in vector $X^p(k)$ according to the general vector equation:

$$X^p(k+1) = AX^e(k) + BU(k) + C.$$

Block 98 computes the R-step ahead (here R=2) prediction of manifold absolute pressure according to the general equation:

$$X^p(k+R) = \alpha X^e(k) + \beta U(k) + \gamma,$$

which, where R=2, is equivalent to:

$$\begin{aligned} MAP^p(k+R) = {} & \alpha_1MAP^e(k-j) + \\ & \alpha_2MAP^e(k-j+1) + \ldots + \\ & \alpha_{j+1}MAP^e(k) + \alpha_{j+2}MAF^e(k-i) + \\ & \alpha_{j+3}MAF^e(k-i+1) + \ldots + \\ & \alpha_{j+i+2}MAF^e(k) + \beta_1TPS(k) + \beta_2TPS(k-1) + \ldots + \\ & \beta_{o-1}RPM(k) + \beta_oT(k) + \gamma_1. \end{aligned}$$

At block 299, the computer uses the predicted manifold absolute pressure, $MAP^p(k+2)$, and the predicted mass air flow, $MAF^p(k+1)$ in the engine—powertrain control for the vehicle. The computer then stores the measured engine parameters at block 302 and enables the interrupts at block 304.

This implementation of the invention enables those skilled in the art to predict manifold absolute pressure R events ahead using reliable measurements of mass airflow, found through prediction and estimation without the necessity of a mass airflow meter.

The predicted mass air flow and manifold absolute pressure can be used in the vehicle engine—powertrain controls in a manner similar to that described above with reference to FIG. 6.

EXAMPLE 6

Many vehicles with IAC valves do not have position feedback of the IAC valve. In such vehicles the IAC valve position command is used as the measure of IAC valve position, IAC(k). If the IAC valve develops a positional bias error, then a consistent error in the predicted state may occur. A consistent error in the predicted and estimated mass airflow may also occur if mass airflow is predicted and estimated, e.g., EXAMPLE 5 above. A method for estimation and correction of IAC valve position bias error is the subject of copending U.S. patent application Ser. No. 653,923, mentioned above. Relevant portions of the method for estimation and correction of IAC valve position bias errors are also set forth here because implementation of the estimation and correction method may significantly improve the functioning of this invention.

While the engine runs in a steady state, the measures of the various engine parameters remain virtually unchanged from one engine event to the next. Likewise the vector U(k) remains virtually constant while the engine is in steady state. It can be shown that in the same engine conditions the vectors $X^p(k)$ and $X^e(k)$ also achieve a virtual steady state. In such a steady state condition, if there is an error between the predicted engine state $X^p$ and the actual engine state, X, it is fairly consistent. Under certain conditions, this error may be attributable to IAC valve positional bias error.

Certain inputs, such as T(k), ATM(k), and RPM(k) are fairly immune to bias error because of the sensor characteristics and/or the sensor information processing in the vehicle control unit. At engine idle, the throttle is in a closed position, so error in throttle position, TPS(k), can be eliminated at idle. If the model parameters, A, B, and C, and the estimator error coefficients, G, are well chosen, they do not cause a consistent error. Once all of the other factors are eliminated, which can be done at idle (a steady state condition), prediction errors can be attributable to IAC valve positional bias error.

The copending patent application mentioned above explains that a quantization of IAC valve position error may be determined as:

$$\delta u^e = (X_{ss} - X^p_{ss})/\omega_r,$$

where $\delta u^e$ is an estimate of the IAC valve bias error, $X_{ss}$ is the steady state value for X(k) at engine idle, $X^p_{ss}$ is the steady state value for $X^p(k)$ at engine idle, and $\omega_r$ is the term in the r'th row (the same row in U(k) in which IAC(k) is in) and the j+1st column of a matrix Q, defined below. The matrix, Q, is defined by the equation:

$$Q=((I-A(I-GL))^{-1})B,$$

where the superscript "−1" denotes matrix inverse, I is a (j+1)×(j+1) identity matrix, and L is a matrix L=[0 0 . . . 0 1] with the "1" occurring in the j+1st entry. Once $\delta u^e$ is determined, a corrected value for IAC valve position equal to $(IAC(k)+\delta u^e)$ can be used in vector U(k) in place of IAC(k) to calculate $X^p(k+1)$, nullifying the positional bias error of the IAC valve.

Figure 8:
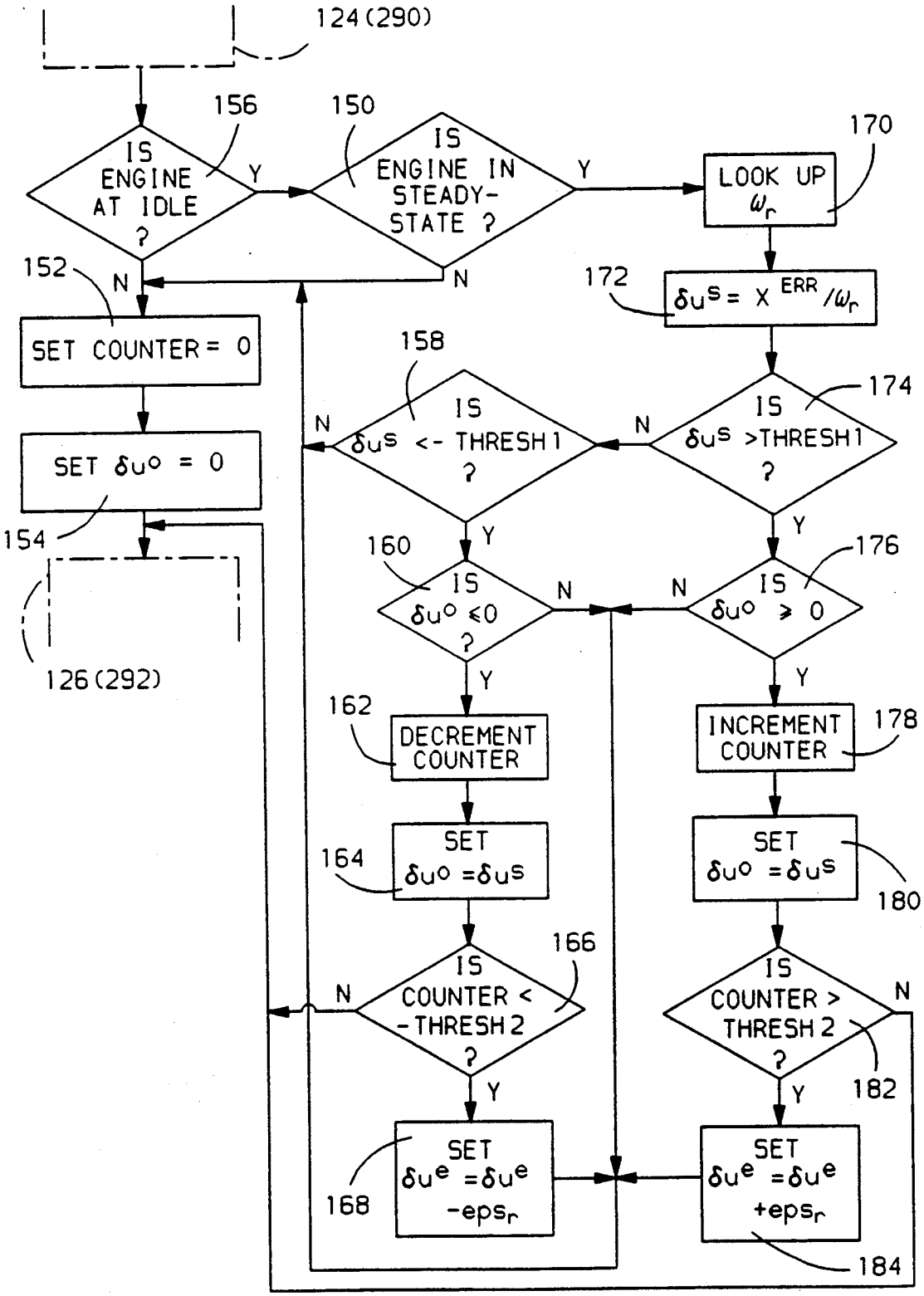
FIG. 8 is a flow diagram for a computer implementation of a method for estimating and correcting bias errors in parameter measurements.

FIG. 8 shows the preferred implementation of the method for estimating and correcting bias errors in the present invention. In the scheme shown, the IAC valve bias error is corrected in small steps, $eps_r$. The decision to take the $eps_r$ step is based on the sign of the bias estimate, $\delta u^e$, the sign of the last bias estimate, and the value of the counter that keeps track of the number of successive times the bias estimates of the same sign exceed a calibrated threshold. This method keeps the value of the sum $(IAC(k)+\delta u^e)$ from wildly varying with every iteration of the routine shown.

More particularly, the routine is implemented between blocks 124 and 126 of FIG. 5, but initialization of the variables required for the routine in FIG. 8 occurs at block 104 in FIG. 5. After the scheduling zone is determined in block 124, block 156 tests to see if the engine is at idle. The engine is at idle if the scheduling zone determined at block 124 is the scheduling zone corresponding to engine idle. If the engine is not at idle, the counter is set to zero at block 152, the last bias estimate, $\delta u^0$, is set to zero at block 154, and the computer continues with its routine at block 126 as described above.

If the engine is found to be at idle at block 156, then block 150 tests to see if the engine is in a steady state. The engine may be said to be in steady state if:

$$TPS(k) \simeq TPS(k-1) \simeq TPS(k-2) \simeq TPS(k-3),$$
$$RPM(k) \simeq RPM(k-1) \simeq RPM(k-2) \simeq RPM(k-3),$$
and
$$MAP(k) \simeq MAP(k-1) \simeq MAP(k-2) \simeq MAP(k-3).$$

Other steady state tests may be employed. If the engine is not in a steady state, then the program continues to block 152. If the engine is in a steady state, then the program moves to block 170 where a value for $\omega_r$ is determined from a lookup table in computer memory.

A present IAC valve error estimate, $\delta u^s$, is determined at block 172 according to the equation: $\delta u^s = X^{err}/\omega_r$. At block 174, the present error estimate is compared to a first threshold (e.g., one increment in IAC valve position command), if the present error estimate is greater than the first threshold then the routine proceeds to block 176, otherwise to block 158. block 176, the previous error estimate, $\delta u^0$, is compared to zero. If the previous error estimate is less than zero, then the computer jumps to block 152. If the previous error estimate is greater than or equal to zero, then the counter is incremented at block 178 and the present error estimate becomes the previous error estimate at block 180.

If the counter is not greater than the second threshold (e.g., 8) at block 182, then the computer jumps to block 126. If the counter is greater than the second threshold at block 182, then the IAC error correction value, $\delta u^e$, is updated at block 184 so that $\delta u^e = \delta u^e + eps_r$. The computer then moves to block 152.

If, at block 174, the present error estimate was not greater than the first threshold, then it is compared to a negative of the first threshold at block 158. If the present error estimate is not less than a negative of the first threshold at block 158, then the computer jumps to block 152. If the present error estimate is less than a negative of the first threshold at block 158, then the previous error estimate is compared to zero at block 160. If the previous error estimate is greater than zero at block 160, then the computer jumps to block 152. If the previous error estimate is not greater than zero at block 160, then the computer moves to block 162 where the counter is decremented and to block 164 where the present error estimate becomes the previous error estimate.

At block 166, the counter is compared to a negative of the second threshold. If the counter is not less than a negative of the second threshold at block 166, then the computer jumps to block 126. If the counter is less than a negative of the second threshold at block 166 then block 168 updates the IAC error correction value, $\delta u^e$, such that $\delta u^e = \delta u^e - eps_r$ and then continues to block 152.

When an error estimation routine such as the routine in FIG. 8 is implemented with this invention, the computation of $X^p(k+1)$ and $X^p(k+R)$ at blocks 132 and 134 uses values equal to the sum $(IAC(k)+\delta u^e)$ in place of IAC(k) to achieve higher accuracy in the prediction of the desired state. The routine described with reference to FIG. 8 is ideal when the predicted state $X^p$ is manifold absolute pressure, $MAP^p$.

The subject invention is not limited to the above described examples but encompasses the use of model-based prediction and error-based correction to accurately predict engine states. Various improvements and modifications to the present invention may occur to those skilled in the art and fall within the scope of the invention as set forth below.

The embodiments of the invention in which an exclusive property or privilege is claimed are defined as follows:

1. An engine—powertrain—controller combination, comprising:

a powertrain receiving power from said engine and including a transmission;

means for determining measures of a set of engine parameters and for providing measurement signals indicative of said measures; and a microprocessor control unit, including (i) means for receiving the measurement signals, (ii) means for predicting a prediction set including at least one predicted value of a desired engine state, and (iii) means for controlling the vehicle engine—powertrain in response to the prediction set, providing improved control of an engine—powertrain parameter comprising: air-fuel ratio, engine idle speed, engine speed, spark timing, or transmission gear selection, wherein the microprocessor control unit iteratively (i) determines the prediction set in response to (a) the measurement signals, (b) a linear model comprising a set of fixed predetermined model parameters, and (c) an estimation set including at least one estimated value of the desired engine state, and (ii) determines the estimation set in response to (a) a present measure of the desired engine state, (b) the prediction set, and (c) a correction set of fixed predetermined correction coefficients wherein the predicted value of the desired engine state is a substantially accurate prediction of the desired engine state's future value.

2. The control system of claim 1 wherein the desired engine state is one state of a set consisting of: manifold absolute pressure, engine speed, and mass air flow.

3. The control system of claim 1 wherein the prediction set includes (i) a predicted value of the desired engine state for one engine event in the future and (ii) a predicted value of the desired engine state for R engine events in the future, where R is at least 1 and wherein the controlling means controls the vehicle engine—powertrain in response to the predicted value of the desired engine state for R engine events in the future.

4. The control system of claim 3, wherein the controlling means controls fueling of the engine by developing a fuel command in response to the predicted value of the desired engine state R engine events in the future and outputting the fuel command to a fuel injection control unit, which fuels the engine in response to the fuel command, thereby improving engine air-fuel ratio control.

5. The control system of claim 1, wherein the controlling means controls fueling of the engine by developing a fuel command in response to the predicted value of the desired engine state and outputting the fuel command to a fuel injection control unit, which fuels the engine in response to the fuel command, thereby improving engine air-fuel ratio control.

6. The control system of claim 4 wherein the desired engine state is one state of a set of states consisting of: manifold absolute pressure, engine speed, and mass air flow.

7. The control system of claim 5 wherein the desired engine state is one state of a set of states consisting of: manifold absolute pressure, engine speed, and mass air flow.

8. The control system of claim 1, wherein the controlling means controls engine spark through spark timing and dwell commands, output to a spark timing control module, by developing the spark timing and dwell commands in response to the predicted value of the desired engine state and outputting the spark timing and dwell commands to the spark timing control module.

9. The control system of claim 3, wherein the controlling means controls engine spark through spark timing and dwell commands, output to a spark timing control module, by developing the spark timing and dwell commands in response to the predicted value of the desired engine state R engine events in the future and outputting the spark timing and dwell commands to the spark timing control module.

10. The control system of claim 8 wherein the desired engine state is one state of a set of states consisting of: manifold absolute pressure, engine speed, and mass air flow.

11. The control system of claim 9 wherein the desired engine state is one state of a set of states consisting of: manifold absolute pressure, engine speed, and mass air flow.

12. The control system of claim 1, wherein the controlling means controls an idle air control valve through an idle air control valve command, by developing the idle air control valve command in response to the predicted value of the desired engine state and outputting the idle air control valve command to the idle air control valve.

13. The control system of claim 3, wherein the controlling means controls an idle air control valve through an idle air control valve command, by developing the idle air control valve command in response to the predicted value of the desired engine state R engine events in the future and outputting the idle air control valve command to the idle air control valve.

14. The control system of claim 12 wherein the desired engine state is one state of a set of states consisting of: manifold absolute pressure, engine speed, and mass air flow.

15. The control system of claim 13 wherein the desired engine state is one state of a set of states consisting of: manifold absolute pressure, engine speed, and mass air flow.

16. The control system of claim 1, wherein the controlling means controls the transmission, through a transmission gear signal, by developing the transmission gear signal in response to the predicted value of the desired engine state and outputting the transmission gear signal to the transmission.

17. The control system of claim 3, wherein the controlling means controls the transmission, through a transmission gear signal, by developing the transmission gear signal in response to the predicted value of the desired engine state and outputting the transmission gear signal to the transmission.

18. The control system of claim 16 wherein the desired engine state is one state of a set of states consisting of: manifold absolute pressure, engine speed, and mass air flow.

19. The control system of claim 17 wherein the desired engine state is one state of a set of states consisting of: manifold absolute pressure, engine speed, and mass air flow.

20. The control system of claim 3, wherein: the prediction set for a given engine event comprises a vector $X^p(k)$ where k is the present engine event, the measures of the set of engine parameters comprise a vector U(k), the estimation set comprises a vector $X^e(k)$, and the set of fixed predetermined model parameters comprises matrices A, B, and C, the prediction set for one engine event in the future being determined by a relation:

$$X^p(k+1)=AX^e(k)+BU(k)+C, \text{ and}$$

the prediction set for R engine events in the future being determined by:

$$X^p(k+R)=A^RX^e(k)+[A^{R-1}B+A^{R-2}B+\ldots+AB+B]U(k)+[A^{R-1}+A^{R-2}+\ldots+A+I]C; \text{ and},$$

the correction set comprises a vector G, and $X^p(k)$ and X(k) represent predicted and measured values of the desired engine state at event k, respectively, the estimation set being determined by a relation:

$$X^e(k)=X^p(k)+G(X(k)-X^p(k)).$$

21. The control system of claim 20 wherein the model parameters are predetermined through statistical regression.

22. The control system of claim 20 wherein the model parameters are scheduled according to two independent engine variables.

23. The control system of claim 1 wherein the correction coefficients are predetermined through Kalman filtering.

24. The control system of claim 20 wherein the correction coefficients are predetermined through Kalman filtering.

25. The control system of claim 1 wherein the set of engine parameters includes throttle position and engine speed.

26. The control system of claim 20 wherein the set of engine parameters includes throttle position and engine speed.

27. The control system of claim 20 wherein the set of engine parameters also includes at least one member of a set comprising: manifold absolute pressure, measured mass air flow, predicted mass air flow, idle air control valve position, exhaust gas recirculation valve position, atmospheric pressure and air temperature.

28. The control system of claim 25 wherein the set of engine parameters also includes at least one member of a set comprising: manifold absolute pressure, measured mass air flow, predicted mass air flow, idle air control valve position, exhaust gas recirculation valve position, atmospheric pressure and air temperature.

29. The control system of claim 26 wherein the set of engine parameters also includes at least one member of a set comprising: manifold absolute pressure, measured mass air flow, predicted mass air flow, idle air control valve position, exhaust gas recirculation valve position, atmospheric pressure and air temperature.

30. An engine—powertrain—controller combination, comprising:

an engine;

a powertrain receiving power from said engine and including a transmission;

means for determining, at successive time events, measures of a set of engine parameters and for providing measurement signals indicative of said measures; and a microprocessor control unit, including (i) means for receiving the measurement signals, (ii) means for predicting from engine information available at event k, a prediction set including at least one predicted value of a desired engine state at an event k+R, where R is at least 1, and (iii) means for controlling the vehicle engine—powertrain in response to the prediction set, providing improved control of an engine—powertrain parameter comprising: air-fuel ratio, engine idle speed, engine speed, spark timing, or transmission gear selection, wherein the microprocessor control unit iteratively:

determines an estimation of the desired engine state in response to a present measure of the desired engine state, a prediction of the desired engine state at event k, and a set of fixed predetermined correction coefficients;

determines the prediction of the desired engine state at an event k+1 in response to information including (i) the measurement signals including signals indicative of the measures of the set of engine parameters at event k and previous events, (ii) the estimation of the desired engine state, and (iii) a set of fixed predetermined model parameters; and determines the predicted value of the desired engine state at event k+R in response to information including (i) the measurement signals including signals indicative of the measures of the set of engine parameters at event k and previous events, (ii) the estimation of the desired engine state, and (iii) the set of fixed predetermined model parameters, wherein the predicted value of the desired engine state at event k+R is a substantially accurate representation of a value of the desired engine state at event k+R.

31. The control system of claim 30 wherein the desired engine state is one state of a set consisting of: manifold absolute pressure, engine speed, and mass air flow.

32. The control system of claim 31 wherein the set of engine parameters includes throttle position and engine speed.

33. The control system of claim 32 wherein the set of engine parameters also includes at least one member of a set comprising: manifold absolute pressure, measured mass air flow, predicted mass air flow, idle air control valve position, exhaust gas recirculation valve position, atmospheric pressure and air temperature.

34. An engine—powertrain—controller combination, comprising:

an engine;

a powertrain receiving power from said engine and including a transmission;

means for determining, at successive time events, measures of a set of engine parameters and for providing measurement signals indicative of said measures; and a microprocessor control unit, including (i) means for receiving the measurement signals, (ii) means for predicting, from engine information available at event k, a prediction set including at least one predicted value of a desired engine state at an event k+R, where R is greater than zero, and (iii) means for controlling the vehicle engine—powertrain in response to the prediction set, providing improved control of an engine—powertrain parameter comprising: air-fuel ratio, engine idle speed, engine speed, spark timing, or transmission gear selection, wherein the microprocessor control unit:

initializes a set of variables including the set of engine parameters for events preceding time k; thereafter iteratively:

receives the measurement signals for event k;

determines an error signal in response to a difference between a measure of the desired engine state at event k and a prediction of the desired engine state for event k;

schedules a set of fixed predetermined correction coefficients in response to two of the measurement signals representing independent engine parameters;

determines a set of estimated values of the desired engine state in response to the prediction set, the error signal, and the set of fixed predetermined correction coefficients;

schedules a set of fixed model parameters in response to the two measurement signals representing independent engine states;

determines the prediction set in response to the measurement signals for event k and preceding events, the set of estimated values, and a set of fixed predetermined model parameters, the prediction set including a prediction of the desired engine state at event k+1; and determines engine—powertrain control in response to the prediction set.

35. The control system of claim 34 wherein the set of model parameters and the set of correction coefficients are scheduled from look-up tables within control unit memory.

36. The control system of claim 34 wherein the desired engine state is one state of a set of states consisting of: manifold absolute pressure, engine speed, and mass air flow.

37. The control system of claim 34 wherein the set of engine parameters includes throttle position and engine speed.

38. The control system of claim 37 wherein the set of engine parameters also includes at least one member of a set comprising: manifold absolute pressure, measured mass air flow, predicted mass air flow, idle air control valve position, exhaust gas recirculation valve position, atmospheric pressure and air temperature.

* * * * *